US006267922B1

(12) United States Patent
Bull et al.

(10) Patent No.: US 6,267,922 B1
(45) Date of Patent: Jul. 31, 2001

(54) PRECIPITATION-HARDENED ALUMINUM ALLOYS FOR AUTOMOTIVE STRUCTURAL APPLICATIONS

(75) Inventors: Michael Jackson Bull, Brighton, MI (US); Alok Kumar Gupta; Michael John Wheeler, both of Kingston (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/029,133

(22) PCT Filed: Sep. 18, 1996

(86) PCT No.: PCT/CA96/00617

§ 371 Date: May 28, 1998

§ 102(e) Date: May 28, 1998

(87) PCT Pub. No.: WO97/11203

PCT Pub. Date: Mar. 27, 1997

Related U.S. Application Data

(60) Provisional application No. 60/003,945, filed on Sep. 19, 1995.

(51) Int. Cl.[7] ..... C22C 21/08; C22C 21/16

(52) U.S. Cl. ..... 420/534; 420/535

(58) Field of Search ..... 148/417, 700; 420/534, 535

(56) References Cited

U.S. PATENT DOCUMENTS

| | | | |
|---|---|---|---|
| 3,594,133 | 7/1971 | Cole et al. | 148/540 |
| 4,082,578 | 4/1978 | Evancho et al. | 148/535 |
| 4,589,932 | 5/1986 | Park | 148/690 |
| 4,784,921 | 11/1988 | Hyland et al. | 428/654 |
| 4,840,852 | 6/1989 | Hyland et al. | 428/654 |
| 5,571,347 * | 11/1996 | Bergsma | 148/550 |

FOREIGN PATENT DOCUMENTS

| | | | |
|---|---|---|---|
| 1183703 | 3/1985 | (CA) | 75/82 |
| 2096366 | 12/1993 | (CA) . | |
| 2152402 | 5/1995 | (CA) . | |
| 0 679 199 B1 | 11/1994 | (EP) . | |
| 2407049 | 5/1979 | (FR) . | |
| 2601040 | 1/1988 | (FR) . | |
| 1129676 | 10/1968 | (GB) . | |
| 9514113 | 5/1995 | (WO) . | |

OTHER PUBLICATIONS

Translation of WO 95/14113 May 1995 Rhenalu, P.
Patent Abstracts of Japan vol. 94, No. 0010, *Japanese Patent Abstract* 06 287671 (Kyushu Mitsui Alum. Kogyo K.K.) Oct. 11, 1994.
Patent Abstracts of Japan vol. 18, No. 068, Feb. 4, 1994, *Japanese Abstract 05 279780* (Furukawa Alum. Co. Ltd.) Oct. 26, 1993.
International Preliminary Examination Report PCT Written Opinion Nov. 28, 1996.
"Aluminium Automobil und Recyclying"; *Bericht Nr.*:515; Auftraggeber:Aluminium–Zentrale e.V.; Verfasser: Dipl.–Ing.C.Rink (no translation available) Apr. 1994.

* cited by examiner

*Primary Examiner*—Roy King
*Assistant Examiner*—Tima McGuthry-Banks
(74) *Attorney, Agent, or Firm*—Cooper & Dunham LLP

(57) ABSTRACT

An aluminum alloy containing the following elements in the stated amounts: $0.6 \leqq Mg \leqq 0.9$; $0.25 \leqq Si \leqq 0.6$; $0.25 \leqq Cu \leqq 0.9$; Fe<0.4; Mn<0.4; the total of the amounts of Cu, Si and Mg being, in atomic weight percent, more than 1.2% and less than 1.8%. These alloys may be subjected to homogenization at about 470 to 560° C. for more than four hours, hot rolling at a temperature in the range of 400 to 580° C., cold rolling, solutionizing at a temperature in the range of 470 to 580° C., and natural aging at ambient temperature. The alloys may then be used as structural components for all aluminum vehicles and may be recycled with other aluminum alloys used in such vehicles.

8 Claims, 2 Drawing Sheets

Ageing characteristics of #15 alloy at different temperatures
(a) 160° C (b) 180° C (c) 200° C Ageing characteristics of #15 alloy at different temperatures
(a) 160° C (b) 180° C (c) 200° C Ageing characteristics of #16 alloy at different temperatures
(a) 160° C (b) 180° C (c) 200° C

PRECIPITATION-HARDENED ALUMINUM ALLOYS FOR AUTOMOTIVE STRUCTURAL APPLICATIONS

CROSS REFERENCE TO RELATED APPLICATIONS

This application claims the benefit of U.S. Provisional Application No. 60/003,945, filed Sep. 19, 1995.

TECHNICAL FIELD

This invention relates to precipitation-hardened aluminum alloys intended primarily for automotive structural applications. More particularly, the invention relates to such alloys within the 6000 series (aluminum alloys wherein the major alloying elements are magnesium and silicon).

BACKGROUND ART

The use of aluminum sheet material is increasing steadily in the manufacture of light-weight automobiles and similar vehicles. For skin applications, such as hoods, trunk lids and fenders, alloy AA6111 is becoming the preferred choice of the North American automakers. This alloy, developed by Alcan, the assignee of the present application, has good forming properties prior to a paint/bake cycle and good dent resistance after forming and painting. For body structure construction, however, the alloy is too strong and the medium strength AA5754 alloy has been recommended for this application (so-called 5000 series aluminum alloys have magnesium as the major alloying element and are generally softer than the 6000 series aluminum alloys). For the most part, 5000 series alloys are well suited for manufacturing all-aluminum body structures, but somewhat higher strength would be advantageous and there is a concern about the recycling of vehicles containing both 5000 and 6000 series alloys since they are chemically incompatible.

Aluminum alloys suggested for use in the automotive industry include those disclosed in the following U.S. Pat. Nos.: 4,082,578 to Evancho et al.; 4,589,932 to Park; 4,784,921 to Hyland et al.; and 4,840,852 also to Hyland et al.

Unfortunately, no known aluminum alloys that are chemically compatible with skin alloy AA6111 satisfy the demands of structural applications in vehicles, including adequate (but not too high) strength and an ability to collapse uniformly upon impact.

DISCLOSURE OF THE INVENTION

An object of the present invention is to provide an aluminum alloy that can be recycled with aluminum alloys used for skin applications in vehicles, particularly alloy AA6111.

Another object of the invention is to provide an aluminum alloy of the 6000 series that is suitable for structural applications in vehicles.

The inventors of the present invention have found that the yield strength in the T4 temper (solution treated and naturally aged) of the aluminum alloys considered here, change linearly with total amounts of Cu, Mg and Si in the alloy matrix when this is expressed in atomic weight percent. Further, the desired combination of mechanical properties is obtained when the total amount of Cu, Mg and Si in atomic weight percent is more than 1.2 and less than 1.8%, and preferably, the total amount is between 1.2 and 1.4 atomic weight percent.

Therefore, according to one aspect of the invention, there is provided a rolled aluminum alloy material in which the alloy contains in weight percent:

$$0.60 \leqq Mg \leqq 0.9$$
$$0.25 \leqq Si \leqq 0.6$$
$$0.25 \leqq Cu \leqq 0.9$$

where, additionally, the total amount of (Cu+Mg+Si) in atomic weight percent is less than 1.8% and more than 1.2%.

The alloy may also contain one or more additional elements, including (in weight percent): Fe up to 0.4%, Mn up to 0.4%, Cr up to 0.1%, V up to 0.1%, Zn up to 0.25%, Ti up to 0.10%, Be up to 0.05% and Zr up to 0.1%. In the presence of Fe, or Fe and Mn together, the Si in the matrix is reduced by ⅓ of the amount of Fe or (Fe+Mn) in weight percent as a result of the formation of insoluble Fe-bearing intermetallic compounds. When the overall Si content is in the low part of the stated range (i.e. 0.25–0.3 wt.%), compensation may be made for this loss by the addition of an excess of Si equal to ⅓ of the amount of Fe or Fe+Mn. The maximum total Si level that can result from such additions would be 0.57% by wt., i.e.:

$$\frac{0.4\ \%\ Fe + 0.4\ \%\ Mn}{3} + 0.3\ \%\ Si$$

which is still within the stated range for the Si content, namely 0.25 to 0.6% by wt. Hence, such compensations (when employed) do not affect the ranges required by the present invention for the amounts of the Si.

Alloys in the above composition ranges and processed according to conventional conditions, including homogenization between 470 and 580° C., hot rolling between 450 to 580° C. to an intermediate thickness, cold rolling to final thickness in one or more passes, solutionizing between 470 and 580° C., rapidly cooling and natural ageing at room temperature, are suitable for structural applications in aluminum intensive vehicles.

Alloys of the invention are of medium strength and have good long-term stability and resistance to over-ageing. As such, the alloys offer good crash-worthiness properties in that structural members constructed from these alloys convolute smoothly and resist cracking when subject to an impact collapse force, even after prolonged exposure to above-ambient temperatures, which would cause loss of ductility and cracking with conventional 6000 series alloys. The alloys also have good recycling compatibility with other aluminum alloys used in vehicle construction.

While the alloys of the invention are intended primarily for vehicle structural purposes, they are also suitable for body panel applications and other applications, here e.g. as extrusions for automotive structural members, again because of their good combination of a modest T4 strength level and good long term thermal stability.

For ease of understanding, some of the terms used in the present application will be explained immediately below before progressing to a more detailed description of the invention.

The term "T8 temper" designates an alloy that has been solution heat-treated, cold worked and then artificially aged. Artificial aging involves holding the alloy at elevated temperature(s) over a period of time. An alloy that has only been solution heat-treated and artificially aged is said to be in the "T6 temper", whereas if the aging has taken place naturally under room temperature conditions, the alloy is said to be in the "T4 temper."

The term "body-structure" is an expression used in the automotive trade to describe the structural frame of an automobile to which the main closure sheet components (fenders, doors, hood and trunk lid), and all the engine, transmission and suspension units, are subsequently attached.

BEST MODES FOR CARRYING OUT THE INVENTION

Figure 1:
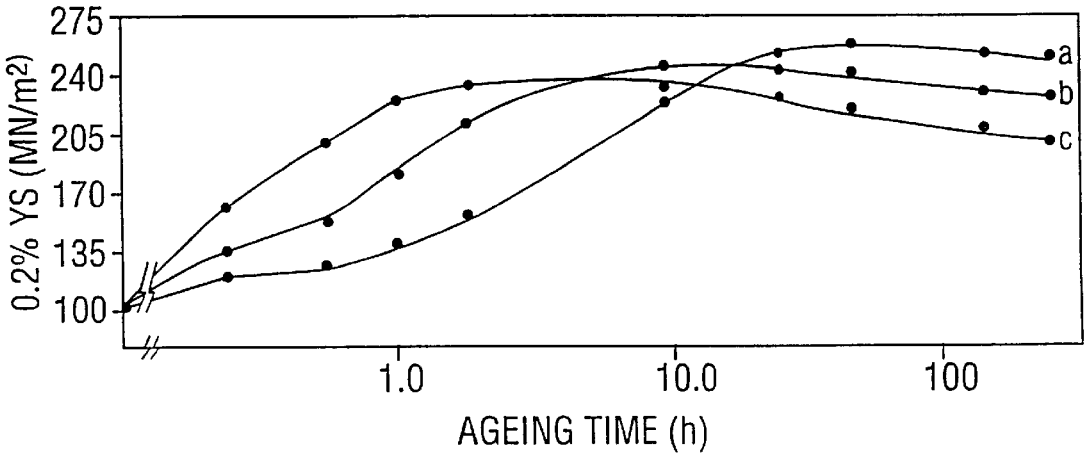
FIGS. 1 and 2 are graphs of yield strength against aging time for two alloys, one according to the invention (FIG. 1) and one not according to the invention (FIG. 2), as explained later in the disclosure.

The inventors of the present invention have determined from engineering considerations and tests that alloys suitable for structural applications in vehicles should desirably have a yield strength (YS) in the range of about 85 to 125 MPa (the unit MPa=$10^6$N/m$^2$=MN/m$^2$), that desirably should increase as the result of forming and adhesive curing and/or paint baking but should not reach a strength of more than about 290 MPa under the extremes of forming and subsequent thermal treatments. This is because experience has shown that materials above this strength level exhibit cracking on impact collapse. Finally, some vehicle components such as those in proximity to the exhaust system may be exposed to elevated temperatures for a long period, and again it is important that the yield strength should not increase over the above guideline figure of 290 MPa, or that the material overage and suffer significant loss of yield strength. Such situations have been simulated by subjecting materials to various combination of elevated temperature for extended times, such as one week at 180° C. or 24 h at 200° C.

In addition to these performance characteristics, the ability of materials to be recycled is an important consideration. An alloy mix resulting from a scrapped and shredded aluminum body structure should be suitable for the making of new structural body sheet without requiring significant dilution with primary mee 5000 series aluminum sheet and perhaps some 6000 series aluminum extrusions will be used in an aluminum intensive automobile, any proposed new alloy which is to be "recycling compatible" must contain Mg, Cu, Si and have a tolerance for Fe and, to a lesser extent, for Mn.

Alloys which rely on excess Si to promote $Mg_2Si$ (βphase) precipitation are inherently difficult to control because, in order to achieve a sufficiently rapid age-hardening response, the level of Si would be such that unavoidably high peak yield strengths would be likely (as observed in the AA6111 alloy) and, unless the Fe level were simultaneously controlled, the amount of "free" Si would fluctuate, leading to somewhat variable mechanical properties. Additionally, long-term stability, coupled with a relatively flat overaging capability, is an important consideration, as is relative insensitivity to prestrains (strain before aging) on aging kinetics. Unfortunately, alloys which are strengthened predominantly by $Mg_2Si$ are moderately sensitive to prestrains and, unless Cu is present, are also susceptible to over-aging. To overcome these deficiencies in β-phase ($Mg_2Si$) strengthened alloys, the inventors of the present invention have proposed the addition of Cu to obtain more stable $CuAl_2$ and $CuMgAl_2$ precipitates. However, it has been found that as the combined solute additions of Mg and Cu increase in the presence of Si, an undesirable insoluble α-phase ($Cu_2Mg_8Si_6Al_5$) tends to form. The extent to which this precipitate can be tolerated effectively limits the maximum Si content.

As a result of such considerations and extensive tests, it has now been determined that suitable aluminum alloys contain the following elements in the wt % percents stated below:

| |
|---|
| $0.6 \leqq Mg \leqq 0.9$ |
| $0.25 \leqq Si \leqq 0.6$ |
| $0.25 \leqq Cu \leqq 0.9$ |
| $Fe \leqq 0.4$ |
| $Mn \leqq 0.4$ |

Moreover, it has been discovered that the yield strength of the alloys in the T4 temper increases linearly as a function of the total (Cu+Mg+Si) in the alloy and to obtain medium structural strength, the (Cu+Mg+Si) content in atomic weight percent should be more than 1.2 and less than 1.8, and most preferably between 1.2 and 1.4 atomic weight percent.

For clarity, the calculation of atomic weight % employed in this invention for determining the stated ranges (using Cu as an example) is illustrated below:

$$\text{Atomic weight \% Cu}=f(\text{Cu})/(f(\text{Cu})+f(\text{Mg})+f(\text{Si})+f(\text{Al}))\times 100$$

where:

$f$(Cu)=(weight % of element Cu)/(atomic weight of Cu) and similarly for $f$(Mg) and $f$(Si)

It should be noted that only the amounts of Cu, Mg, Si and Al in the matrix are considered in this calculation, i.e. the weight % Al =100−weight % (Cu+Mg+Si). The effects of Fe and Mn are ignored since their levels do not usually change significantly from one alloy to another. Ideally, due allowance should be made in alloy design for the loss of Si to Fe-bearing intermetallic particles, as described earlier.

Alloys having the above composition ranges and processed according to conventional conditions, including homogenization between 470 and 580° C., hot rolling between 400 to 580° C. to an intermediate thickness, cold rolling to final gauge in one or more passes, solutionizing between 470 and 580° C., rapid cooling and natural aging, are suitable for automotive structural applications.

A particularly preferred aluminum alloy according to the invention is one containing approximately (wt. %).

| | |
|---|---|
| Mg | 0.75% |
| Cu | 0.30% |
| Si | 0.40% |
| Fe | 0.25% |
| Mn | 0.09 |
| Al | balance. |

The invention is illustrated in more detail in the following Examples and Comparative Examples which are not intended to limit the scope of the present invention.

EXAMPLES AND COMPARATIVE EXAMPLES

Example 1

Alloys having the nominal compositions shown in Table 1 below were cast in the laboratory.

TABLE 1

| Alloy | Composition in Weight Percent | | | | | | |
|---|---|---|---|---|---|---|---|
| | Cu | Mg | Si | Fe | Mn | Ti | Cr |
| 1 | 0.41 | 1.50 | 0.79 | 0.14 | 0.05 | 0.01 | " |
| 2 | 0.62 | 1.30 | 0.59 | 0.14 | 0.05 | 0.01 | " |
| 3 | 0.81 | 1.39 | 0.59 | 0.14 | 0.05 | 0.01 | " |
| 4 | 0.99 | 0.97 | 0.58 | 0.13 | 0.05 | 0.01 | " |
| 5 | 0.31 | 0.75 | 0.39 | 0.13 | 0.05 | 0.01 | " |
| 6 | 0.82 | 2.02 | 0.40 | 0.14 | 0.05 | 0.01 | " |
| 7 | 0.30 | 0.55 | 0.69 | 0.22 | 0.05 | 0.01 | " |
| 8 | 0.40 | 0.53 | 1.07 | 0.22 | 0.05 | 0.01 | " |
| 9 | 0.48 | 0.30 | 1.33 | 0.22 | 0.05 | 0.01 | " |
| 10 | 0.50 | 0.63 | 0.30 | 0.21 | 0.05 | 0.01 | " |
| 11 | 0.83 | 0.83 | 0.30 | 0.21 | 0.05 | 0.01 | " |
| 12 | 0.50 | 1.02 | 0.49 | 0.21 | 0.05 | 0.05 | " |
| 13 | 0.10 | 0.40 | 1.22 | 0.29 | 0.08 | 0.01 | — |
| 14 | 0.08 | 0.40 | 0.68 | 0.14 | 0.15 | 0.02 | — |

It is to be noted that only alloys #5, #10 and #11 have compositions falling within the ranges of the invention.

The alloys were scalped, homogenized at 560° C. for four hours, hot and cold rolled to a final thickness of 0.9 mm, and the cold rolled material was solutionized at 560° C. for 30 seconds followed by rapid cooling and naturally aging for one week. The tensile properties of the materials were then determined in various tempers. The formability of the alloys were determined from the spread in UTS and YS, Erichesen cup height, total elongation and minimum bend radius measurements. The properties of the alloys were evaluated in terms of composition and their overall performance compared with that of the AA5754 alloy.

The results are shown in Tables 2 and 3 below.

TABLE 3-continued

| Condition | Desired | 1.2 ≦ (Cu + Mg + Si) ≦ 1.8 (At %) | 1.2 ≦ (Cu + Mg + Si) ≦ 1.4 (At %) |
|---|---|---|---|
| 8% Prestrain + 1 h @ 180° C. (Condition representing maximum strength after adhesive cure followed by paint cure) | 290 | 240–290 | 240–260 |
| 1 Week @ 180° C. (Condition representing situation where the material is exposed to higher temperatures for long times, such as heat shields etc) | 270 | 200–260 | 200–225 |

The results of the tensile tests performed transversely to the rolling direction on all of the alloys in different tempers are shown in Table 2. Table 3 lists the predicted yield strengths (in MPa) for alloys containing (Cu+Mg+Si) in the matrix within the 1.2 and 1.8 atomic weight percent range, using yield strength/atomic weight percent relationships derived from the experimental data for the various aged conditions. Clearly, the alloys containing the total amount of Cu, Mg and Si in the matrix between 1.2 and 1.8 atomic percent, and preferably between 1.2 and 1.4 atomic percent, satisfy the desired combination of tensile properties in different tempers.

Of the tested alloys containing Cu, Mg and Si in the preferred range, alloy #5 was found to have the most satisfactory properties. This alloy can accept some Si and Cu

TABLE 2

| Alloy | T4 | | | 1 h @ 180° C. | | | 8% st. + 1 h @ 180° C. | | | 1 h @ 205° C. | | | 8% st. + 1 h @ 205° C. | | | 24 h @ 200° C. | | | 1 Week @ 180° C. | | |
|---|---|---|---|---|---|---|---|---|---|---|---|---|---|---|---|---|---|---|---|---|---|
| | YS MPa | UTS MPa | % El | YS MPa | UTS MPa | El % | YS MPa | UTS MPa | % El | YS MPa | UTS MPa | % El | YS MPa | UTS MPa | % El | YS MPa | UTS MPa | % El | YS MPa | UTS MPa | % El |
| 1 | 151.7 | 295.8 | 29 | 190.3 | 306.1 | 25 | 279.9 | 325.2 | 16 | 327.5 | 374.3 | 10 | 335.7 | 347.5 | 8 | 330.2 | 335.0 | 7 | 319.2 | 344.7 | 7 |
| 2 | 146.8 | 293.0 | 30 | 193.7 | 316.4 | 23 | 297.8 | 350.9 | 19 | 316.4 | 379.9 | 15 | 307.5 | 326.1 | 10 | 328.2 | 373.7 | 10 | 313.0 | 356.4 | 9 |
| 3 | 146.8 | 299.9 | 30 | 207.5 | 331.6 | 25 | 302.6 | 360.6 | 18 | 314.4 | 393.0 | 15 | 339.2 | 360.6 | 9 | 340.6 | 395.7 | 11 | 333.7 | 377.1 | 8 |
| 4 | 155.8 | 308.2 | 28 | 215.1 | 236.4 | 23 | 326.1 | 375.7 | 18 | 350.2 | 414.3 | 13 | 356.4 | 370.9 | 8 | 358.5 | 396.4 | 9 | 344.0 | 377.8 | 8 |
| 5 | 94.4 | 219.2 | 28 | 140.6 | 251.6 | 25 | 232.3 | 279.2 | 16 | 254.4 | 289.5 | 8 | 254.4 | 270.2 | 9 | 247.5 | 274.4 | 9 | 254.5 | 278.5 | 8 |
| 6 | 124.8 | 273.0 | 25 | 191.0 | 304.0 | 14 | 247.5 | 313.7 | 12 | 252.3 | 349.5 | 12 | 277.1 | 308.2 | 11 | 282.0 | 360.6 | 9 | 267.5 | 343.3 | 9 |
| 7 | 103.4 | 230.3 | 27 | 168.9 | 257.8 | 20 | 255.8 | 290.9 | 14 | 264.7 | 293.7 | 10 | 287.5 | 301.3 | 8 | 223.4 | 258.5 | 7 | 230.7 | 263.7 | 8 |
| 8 | 126.8 | 265.4 | 27 | 185.4 | 286.1 | 23 | 292.3 | 328.2 | 14 | 266.8 | 319.2 | 12 | 284.0 | 304.0 | 7 | 246.1 | 285.4 | 8 | 239.9 | 278.1 | 9 |
| 9 | 104.8 | 244.7 | 30 | 128.9 | 247.5 | 24 | 251.6 | 297.8 | 13 | 215.8 | 284.7 | 15 | 253.0 | 287.5 | 8 | 201.3 | 255.1 | 9 | 201.6 | 261.5 | 10 |
| 10 | 67.6 | 187.5 | 29 | 114.4 | 213.0 | 22 | 189.6 | 236.5 | 15 | 177.9 | 239.2 | 14 | 230.3 | 255.8 | 10 | 216.5 | 260.6 | 11 | 224.5 | 272.4 | 12 |
| 11 | 80.0 | 206.1 | 26 | 135.1 | 239.2 | 20 | 206.8 | 258.5 | 15 | 195.8 | 262.7 | 14 | 247.5 | 275.1 | 10 | 228.9 | 280.6 | 11 | 233.4 | 289.8 | 12 |
| 12 | 113.8 | 252.3 | 26 | 184.8 | 293.0 | 21 | 268.9 | 315.7 | 16 | 261.3 | 321.3 | 13 | 319.2 | 337.1 | 9 | 288.2 | 333.7 | 11 | 291.6 | 339.8 | 11 |
| 13 | 114.4 | 234.4 | 28 | 165.5 | 255.1 | 21 | 259.2 | 293.7 | 13 | 242.0 | 277.8 | 11 | 253.0 | 275.1 | 9 | 158.6 | 199.9 | 9 | 196.5 | 236.5 | 8 |
| 14 | 92.4 | 204.0 | 23 | 140.6 | 235.8 | — | 224.7 | 258.5 | 14 | 230.9 | 265.4 | 11 | 248.9 | 263.4 | 10 | 199.2 | 230.3 | 8 | 199.2 | 230.9 | 8 |

TABLE 3

| Condition | Desired | 1.2 ≦ (Cu + Mg + Si) ≦ 1.8 (At %) | 1.2 ≦ (Cu + Mg + Si) ≦ 1.4 (At %) |
|---|---|---|---|
| As Supplied (Equivalent to AA5754) | 85–125 | 85–125 | 85–100 |
| No Prestrain + 1 h @ 180° C. (Condition representing minimum strength after adhesive cure followed by paint cure) | — | 130–170 | 130–160 |

and has good bendability and good formability. The strength after minimum cure was about 140 MPa, which is satisfactory.

Alloy #10 had good tolerance for Cu and good formability characteristics. The minimum yield strength after minimum cure was a little low (about 114 MPa) but this figure is still acceptable.

Alloy #11 has a high tolerance for Cu (the same as alloy AA6111) and good formability. The minimum strength after minimum cure was about 135 MPa, which is quite good.

It should be noted that the minimum strengths of the alloys can be raised further by a preaging practice, identified here as producing a T4P temper. Such practices characteristically improve only short aging time/low temperature aging strengthening response and does not alter either the yield strength in the T6 temper or long term strength or stability.

The results of various forming tests are summarized in Table 4. The alloys, #5 and #7 through 14, containing the total Cu, Mg and Si in the matrix between 1.2 and 1.8 atomic weight % show high tensile strength to yield strength (UTS/YS) ratio, improved Erichsen cup height and low r/t values in comparison with those for alloys outside the desired composition range of the invention.

TABLE 4

| Alloys | UTS/YS | El(%) | Erichsen Ht (mm) | Bend Radius/Sheet thickness, (r/t) Longitudinal | Transverse |
|---|---|---|---|---|---|
| 1 | 1.95 | 29 | 8.1 | 0.4 | 0.6 |
| 2 | 1.99 | 30 | 8.3 | 0.4 | 0.4 |
| 3 | 2.04 | 30 | 8.0 | 0.3 | 0.6 |
| 4 | 1.98 | 28 | 8.1 | 0.3 | 0.3 |
| 5 | 2.32 | 28 | 8.3 | 0.3 | 0.3 |
| 6 | 2.19 | 25 | 7.9 | 0.4 | 0.4 |
| 7 | 2.23 | 27 | 8.5 | 0.4 | 0.3 |
| 8 | 2.09 | 27 | 8.5 | 0.4 | 0.3 |
| 9 | 2.33 | 30 | 8.8 | 0.4 | 0.4 |
| 10 | 2.77 | 29 | 8.8 | 0.5 | 0.4 |
| 11 | 2.58 | 26 | 8.8 | 0.3 | 0.4 |
| 12 | 2.22 | 26 | 8.5 | 0 | 0 |
| 13 | 2.05 | 28 | — | 0.3 | 0.3 |
| 14 | 2.21 | 23 | 8.3 | 0 | 0 |

naturally aged for ten days. The materials were then evaluated for tensile and forming characteristics in the T4 temper. In addition, tensile properties and crash performance of both the materials in different aged tempers were also determined.

Table 6 lists average tensile properties in transverse direction of alloys #15, 16 and AA5754 in the T4 and O-tempers respectively and after various other thermal treatments. It can be seen that the yield strength of alloy #15 of the invention in various tempers is always below 290 MPa. Further, as desired, the yield strength of the alloy in T4 temper is comparable with that of the AA5754 and it is significantly higher in other tempers. On the other hand, alloy #16, which is outside the composition range of the invention, is too strong in the T4 temper and in the 8% prestrain +1 h @ 205° C. condition.

Figure 2:
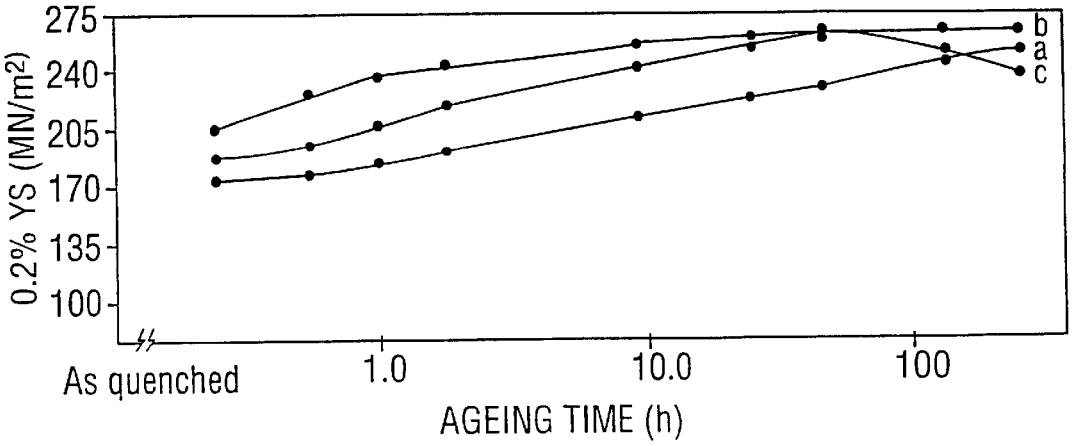

The effects of artificial ageing of alloys #15 and #16 at 160, 180 and 200° C. are shown in FIGS. 1 and 2, respectively, of the accompanying drawings. These graphs show that alloy #15 is acceptable since its yield strength never exceeds 260 MPa, while once again, alloy #16 is not acceptable.

The results of various forming tests conducted on alloys #15, #16 and AA5754 are listed in Table 7. It can be seen that alloy #15 shows minimum r/t value of 0.12 in both longitudinal and transverse directions, maximum dome height of 11.2 mm in the Erichsen cup test and 55.7 mm displacement in the biaxial strain test. These values are comparable to those of AA5754, while alloy #16 show clearly inferior properties.

TABLE 6

| | T4 | | | 1 h @ 180° C. | | | 8% st. + 1 h @ 180° C. | | | 1 h @ 205° C. | | | 8% st. + 1 h @ 205° C. | | | 24 h @ 200° C. | | | 1 Week @ 180° C. | | |
|---|---|---|---|---|---|---|---|---|---|---|---|---|---|---|---|---|---|---|---|---|---|
| Alloy | YS MPa | UTS MPa | % El | YS MPa | UTS MPa | El % | YS MPa | UTS MPa | % El | YS MPa | UTS MPa | % El | YS MPa | UTS MPa | % El | YS MPa | UTS MPa | % El | YS MPa | UTS MPa | % El |
| AA5754 | 104.1 | 216.5 | 25 | 92.4 | 215.8 | 25 | 137.9 | 226.1 | 16 | 90.3 | 215.1 | 26 | 132.4 | 226.1 | 19 | 89.6 | 215.8 | 24 | 89.6 | 215.1 | 24 |
| 15 | 96.3 | 192.4 | 29 | 172.7 | 244.0 | 18 | 233.0 | 271.4 | 12 | 225.2 | 264.1 | 12 | 255.3 | 276.3 | 8 | 218.4 | 250.4 | 9 | 231.6 | 261.9 | 12 |
| 16 | 142.7 | 284.0 | 28 | 200.3 | 317.3 | 23 | 284.6 | 345.0 | 15 | 231.5 | 328.6 | 20 | 307.4 | 352.1 | 13 | 260.3 | 334.9 | 11 | 268.3 | 343.4 | 14 |

TABLE 5

| Alloys | Composition in Weight Percent Cu | Mg | Si | Fe | Mn | Ti | Cr |
|---|---|---|---|---|---|---|---|
| AA5754 | 0.01 | 2.9 | 0.07 | 0.20 | 0.25 | 0.01 | <0.005 |
| 15 | 0.28 | 0.71 | 0.38 | 0.24 | 0.09 | 0.06 | <0.005 |
| 16 | 0.78 | 1.75 | 0.38 | 0.23 | 0.11 | 0.07 | <0.005 |

Example 2

DC ingots, 600×1800×3429 mm of alloys #15 and #16 with the compositions listed in Table 5 were cast on a commercial scale. Table 5 also shows the composition of typical commercial AA5754 material. It should be noted that alloy #15 has a composition falling within the ranges of the invention while alloy #16 is outside the range of the invention. Both alloy ingots were scalped 6 mm per rolling face, homogenized 18 h @ 560° C. and hot rolled to 5 mm gauge, cold rolled to a final thickness of 1.6 mm in two passes. The cold rolled material was solutionized in a continuous solution heat treatment line at 540° C, rapidly cooled and

TABLE 7

| Alloy # | Erichsen Value, mm | r/t Bend L | T | Biaxial Strain Displacement, mm | Draw Strain Path Displacement, mm |
|---|---|---|---|---|---|
| 15 | 11.2 | 0.12 | 0.12 | 55.7 ± 1.3 | 30.7 ± 0.8 |
| 16 | 10.4 | 0.47 | 0.47 | 54.78 ± 0.5 | 33.1 ± 1.8 |
| AA5754-0 | 11.8 | 0.15 | 0.15 | 57.9 ± 0.4 | — |

Crash Worthines Tests

Crash worthiness (slow crush performance) tests were carried out on these alloys #15 and #16 with a view to obtaining information on how these alloys perform in a vehicle structure which has undergone exposure to elevated temperatures during manufacture and general vehicle operation. In order to simulate this, several of the specimens were exposed to elevated temperatures for various time periods prior to testing. The results were then compared against benchmark values of impact performance taken from previous tests of AA5754 and AA6111 alloys.

In more detail, hexagonal sections were formed from 1.6 mm bare material and collapse initiators were formed into the upper section of each sample. The flanges were pre-punched to accept Hemlock rivets and a 407-47 dip-pretreatment was applied prior to bonding and final assembly. In the case of the over-aged samples (24 hours at 210° C.), the pretreatment and bonding was carried out after the aging process in order that the adhesive properties not be affected by the high oven temperatures. Adhesive XD4600 (Trademark of Ciby-Geigy) was used throughout the tests as a bonding agent and the sample geometry used was 50 mm along each face of the hexagon with two 19 mm bonding seams at opposite sides and a total length of 400 mm.

Prior to testing, the samples were exposed to one of the following conditions:

*T*4+cure cycle+30 minutes at 180° C. (1)

*T*4+cure cycle+90 minutes at 180° C.+8 hours at 120° C. (2)

*T*4+cure cycle+30 minutes at 180° C.+8 hours at 120° C. (3)

*T*4+cure cycle+30 minutes at 180° C.+20 hours at 120° C. (4)

*T*4+24 hours at 210° C.+cure cycle. (5)

The samples were then placed on an hexagonal aluminum insert and crushed in an ESH servo-hydraulic test machine. The aluminum insert was used to stabilize the bottom of the section during crushing.

A summary of the results is shown in Table 8 below:

TABLE 8

| | Alloy #15 | | | Alloy #16 | | |
|---|---|---|---|---|---|---|
| Condition[1] | $P_{AVE}$ (kN)[3] | 2h (mm)[4] | Rating of Structural Integrity[2] | $P_{AVE}$ (kN)[3] | 2h (mm)[4] | Rating of Structural Integrity[2] |
| 1 | 37.9 | 33 | ✓✓ | 44.0 | 34.5 | x x |
| 2 | 40.1 | 36 | ✓ | 46.7 | 35.5 | x x |
| 3 | 42.0 | 31.5 | ✓ | | | |
| 4 | 40.9 | 35 | ✓ | | | |
| 5 | 41.3 | 31 | ✓✓ | 52.9 | 29.5 | x |

[1]Conditions 1–5 are those described immediately before Table 8.
[2]The symbols used in the Ratings of Structural Integrity are as follows:
✓✓✓ No visible cracks
✓✓ Minor cracks, but not through thickness
✓Small cracks (<25 mm)
x Major cracks and large tears
x x Complete panel splitting/instability
x x x Total disintegration
[3]$P_{AVE}$ are average crush force values obtained by plotting load against displacement and deriving the average force during the crush from the plot. The values are expressed in kilonewtons (kN).
[4]In the folding wave ("2h") values, the "h" parameter is ½ of the pitch between successive folds of the metal. Therefore, "2h" is one full pitch measurement.

For comparison purposes, results for AA5754-O and AA6111-T4 alloys, based on 1.6 mm gauge material are provided in Table 9 below. It should be noted, however, that these values were predicted from a computer programme (CrashCAD—Trademark- software), and are based on previously obtained experimental results in 2 mm AA5754-O and 1.8 mm AA6111-T4 (both with a one adhesive cure cycle).

TABLE 9

| Average Crush Force $P_{AVE}$ (kN) | | | |
|---|---|---|---|
| Alloy #15-T4 | Alloy #16-T4 | AA5754-O | AA6111-T4 |
| 37.9 | 44.0 | 31.6 | 53.5 |

The results show that the alloy #15 performed well in terms of crash performance throughout a range of simulated vehicle history and process conditions with the $P_{ave}$ value being virtually independent of the prior thermal history. There were some evidence of small cracks within the concertina fold webs of the impact tested beams but these were less than 25 mm in length and were clearly caused by impingement of one fold into the web area of the adjacent fold very late in the collapse event. No cracks developed at the actual fold lines.

The fact that the $P_{ave}$ is effectively independent of the prior thermal history is very important from a design viewpoint since the impact performance of a vehicle built with this material would be independent of its service history. This would certainly not be the case for either the alloys #16 or AA6111 and is a further indication of the remarkable thermal stability of the alloy #15. The $P_{ave}$ for alloy #15-T4 is some 20–30% greater than that for AA5754-0 and would therefore allow a gauge and hence a weight reduction compared with 5754-0 material.

In contrast, the alloy #16 showed much poorer crash performance. Although the average crush force were 40–67% higher than the predicted AA5754-O values, the aluminum panels split very seriously and lost structural integrity.

In conclusion, the test results show that alloy #15 has a good balance of characteristics and performs well in axial collapse. However, alloy #16 cannot be recommended for components subject to axial collapse due to excessive cracking and splitting of the sheet material.

Example 3

Recycling

Calculations made using the weight of aluminum materials used in the Ford AIV vehicles (aluminum intensive vehicles) clearly demonstrate the advantages for an alloy based on-the present invention for the time when AIVs are scrapped and it is the intention to use the resulting mixture of aluminum alloys to make sheet for new AIVs.

The Ford AIV has a sheet based aluminum body structure weighing 145 kg (320 lb) and aluminum closure panels weighing 53 kg (117 lb). If the structure is made entirely of AA5754 alloy and the closure panels of AA6111 alloy then, when these components become mixed together on shredding and remelting, Table 10 below shows that only some 14.5 kg (32 lb) of the scrap mix could be used in the production of the required weight of AA5754 structural sheet for a new AIV. Similarly, only some 16.8 kg (37 lb) of the scrap alloy could be used in the making of the required 53 kg (117 lb) of closure sheet. These numbers assume that there is essentially no compromise in the nominal compositions of the new material and this scenario also shows that some 161.5 kg (356 lb) of primary grade aluminum would be needed to make up the required quantities of structural and skin materials. Clearly this indicates that, with this combination of alloys, it would be more appropriate to sort and segregate the materials prior to remelting.

Table 10 also shows the results of similar calculations for a structural alloy based on the present invention. Here some 103.5 kg (228 lb) of the mixed scrap can be used in the production of new structural sheet of the original composition and 100% of the new AA6111 closure panel sheet could be sourced from the mixed scrap. Thus, together, only 41 kg (91 lb) of primary metal would be required to make sufficient sheet for a new AIV.

TABLE 10

| | | | Scrap Utilization in New Vehicle | | Primary Al |
|---|---|---|---|---|---|
| | | Weight kg (lb) | Weight kg (lb) | Percent of the required Metal | Needed * kg (lb) |
| Case 1 | AA5754 Structure | 145 (320) | 14.5 (32) | (10) | 126 (278) |
| | AA6111 Closures | 53 (117) | 16.8 (37) | (31.6) | 35 (78) |
| Case 2 | Alloy #15 Structure | 145 (320) | 103.5 (228) | (71.3) | 41 (91) |
| | AA6111 Closures | 53 117 | 53 117 | (100%) | 0 |

* Some other alloying additions are needed to reach the required weights and the correct compositions.

In practice, 71% recovery of scrapped vehicles is unlikely to be exceeded; aluminum cans, for example, which have been in the market place for more than 20 years have not yet reached this recovery rate. Also, since the life expectancy of an AIV is at least 10 years, only a very modest market growth for AIVs of about 2.5% per annum would be required to absorb all the recycled metal back into new structural and closure panel sheet.

What is claimed is:

1. A rolled aluminum alloy material suitable for use in structural components of a vehicle; wherein said alloy is capable of reaching an ultimate yield strength after forming and subsequent thermal treatment of no more than 290 MPa and said alloy contains, in weight percent:

| |
|---|
| $0.6 \leqq Mg \leqq 0.9$ |
| $0.25 \leqq Si \leqq 0.6$ |
| $0.25 \leqq Cu \leqq 0.9$ |
| $Fe \leqq 0.4$ |
| $Mn \leqq 0.4$ |
| Cr 0 to 0.1 |
| V 0 to 0.1 |
| Zn 0 to 0.25 |
| Ti 0 to 0.1 |
| Be 0 to 0.05 |
| Zr 0 to 0.1 |

balance Al apart from impurities and in that the total of the amounts of Cu, Si and Mg is, in atomic weight percent, more than 1.2% and less than 1.8%.

2. A rolled aluminum alloy material according to claim 1 wherein said total amount of Cu, Si and Mg is between 1.2 and 1.4 atomic weight percent.

3. A rolled aluminum alloy material according to claim 1 wherein the alloy consists essentially of the following elements in amounts in weight percent as stated:

| |
|---|
| Mg 0.75 |
| Cu 0.30 |
| Si 0.40 |
| Fe 0.25 |
| Al balance. |

4. A rolled aluminum alloy material according to claim 1 having a yield strength of 85 to 125 MPa that increases to no more than 260 MPa after forming, adhesive cure and/or paint bake.

5. A rolled aluminum alloy material according to claim 1, wherein said alloy has been subjected to homogenization at 470 to 560° C. for more than four hours, hot rolling at a temperature in the range of 400 to 580° C., cold rolling, solutionizing at a temperature in the range of 470 to 580° C., and natural aging at ambient temperature.

6. A rolled aluminum alloy material according to claim 5 wherein said total of said Cu, Si and Mg is between 1.2 and 1.4 atomic weight percent.

7. A rolled aluminum alloy material according to claim 5 wherein said alloy consists essentially of the following elements in amounts in percent by weight as stated:

| |
|---|
| Mg 0.75 |
| Cu 0.30 |
| Si 0.40 |
| Fe 0.25 |
| Al balance. |

8. A rolled aluminum alloy material according to claim 5 wherein said alloy has a yield strength of 100 to 120 MPa that increases to no more than 260 MPa after forming, adhesive cure and/or paint bake.

* * * * *